US005961353A

United States Patent [19]

Rivenbark

[11] Patent Number: 5,961,353

[45] Date of Patent: Oct. 5, 1999

[54] ADAPTOR FOR CIRCUITING APPLIANCES TO A CIGARETTE LIGHTER SOCKET

[76] Inventor: Ruben L. Rivenbark, P.O. Box 1141, Nashville, Ind. 47448

[21] Appl. No.: 08/947,925

[22] Filed: Oct. 9, 1997

Related U.S. Application Data

[60] Provisional application No. 60/028,565, Oct. 10, 1996.

[51] Int. Cl.[6] ..... H01R 17/18

[52] U.S. Cl. ..... 439/668

[58] Field of Search ..... 439/668, 669, 439/638, 801, 810, 727, 504, 639

[56] References Cited

U.S. PATENT DOCUMENTS 1,597,958 8/1926 Eby ..... 439/727

5,170,067 12/1992 Baum et al. ..... 439/668

5,593,323 1/1997 Dernehl ..... 439/668

*Primary Examiner*—Gary Paumen

*Assistant Examiner*—Briggitte R. Hammond

*Attorney, Agent, or Firm*—Baker & Daniels

[57] ABSTRACT

An adaptor for electrically circuiting wires of an appliance to the electrical contacts standard within a cigarette lighter socket. The housing of the adaptor is insertable into the lighter socket, and electrical contacts projecting from the housing are adapted to engage the lighter socket contacts. The adaptor also includes a pair of externally accessible electrical terminals which are positioned on the housing and to which may be attached wires of an appliance to be powered.

14 Claims, 6 Drawing Sheets

ADAPTOR FOR CIRCUITING APPLIANCES TO A CIGARETTE LIGHTER SOCKET

CROSS-REFERENCE TO RELATED APPLICATION

This application claims the benefit under 35 U.S.C. § 119(e) of U.S. Provisional Application No. 60/028,565, filed Oct. 10, 1996.

BACKGROUND OF THE INVENTION

The present invention pertains to an electrical adaptor, and, in particular, to an electrical adaptor or coupling used to circuit an appliance to a power source in a vehicle.

A wide variety of appliances, such as CB radios, are often used in trucks and other vehicles. Typically these appliances need to be hooked up to an external power source, such as the vehicle power source or battery, to obtain electricity for operation. Because at times the ends of the power cords of electrical appliances are exposed wires, a user may have to tap or tie into the electrical wires within the dashboard in order to wire the CB or other appliance to the vehicle power source. In situations where it is desirable to remove the appliance from the vehicle to, for example, frustrate theft attempts, or where the appliance is only to be used for a short time within that vehicle, it is undesirable and inconvenient to have to tap into the dashboard wiring.

Thus, it would be desirable to provide an apparatus which conveniently allows for an electrical connection with a vehicle power source via the cigarette lighter socket of the vehicle.

SUMMARY OF THE INVENTION

The present invention provides an adaptor that includes exposed terminals to which electrical wiring of an appliance may be attached and which may be plugged into a cigarette lighter socket.

In one form thereof, the present invention provides an electrical adaptor including a plug member sized and configured to insert within a cigarette lighter socket circuited to a power source, first and second electrical contacts positioned externally on the plug member and adapted to electrically connect with socket contacts when the plug member is inserted into the socket, a first electrical terminal positioned externally on the plug member and adapted for connection to a first lead of an electrical appliance, a second electrical terminal positioned externally on the plug member and adapted for connection to a second lead of the electrical appliance, a first circuit electrically connecting the first electrical terminal with the first electrical contact, and a second circuit electrically connecting the second electrical terminal with the second electrical contact.

In another form thereof, the present invention provides an adaptor for circuiting an appliance to a power source circuited with a cigarette lighter socket, including a body movable to an operational position at which an insertion end of the body is removably inserted within the cigarette lighter socket, means on the body for forming electrical connections with contacts of the cigarette lighter socket circuited to the power source when the body in disposed in the operational position, means on the body for attachment to wires of an electrical appliance to be powered by the power source, and means for electrically interconnecting the wire attachment means and the means for forming electrical connections.

In still another form thereof, the present invention provides a method of circuiting an electrical appliance to a power source of a vehicle including a cigarette lighter socket connected to the power source, including the step of providing an adaptor comprising a housing, first and second contacts respectively projecting from an insertion end and a side of the housing, first and second electrical terminals protruding from the housing to be externally accessible, a first electrical circuit within the housing and connecting the first contact and the first electrical terminal, and a second electrical circuit within the housing and connecting the second contact and the second electrical terminal. The inventive method further comprises the steps of connecting a first lead of the electrical appliance to the first electrical terminal, connecting a second lead of the electrical appliance to the second electrical terminal, and inserting the adaptor into the socket such that the first and second contacts are electrically circuited with contacts of the socket to thereby circuit the first and second appliance leads with the vehicle power source.

One advantage of the present invention is that it provides a convenient method of providing for the powering of an electrical appliance temporarily installed within the interior of a vehicle such as a truck.

Another advantage of the present invention is that it permits an electrical appliance being powered by a vehicle's power source to be readily disconnected from that power source, thereby facilitating removing the appliance from the vehicle to prevent the theft of the appliance.

Still another advantage of the present invention is that it allows for the electrical connection of multiple electrical appliances to a vehicle power source.

Still another advantage of the present invention is that its uncomplicated design permits its ready manufacture and assembly, thereby resulting in an product which may be affordable to many users.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
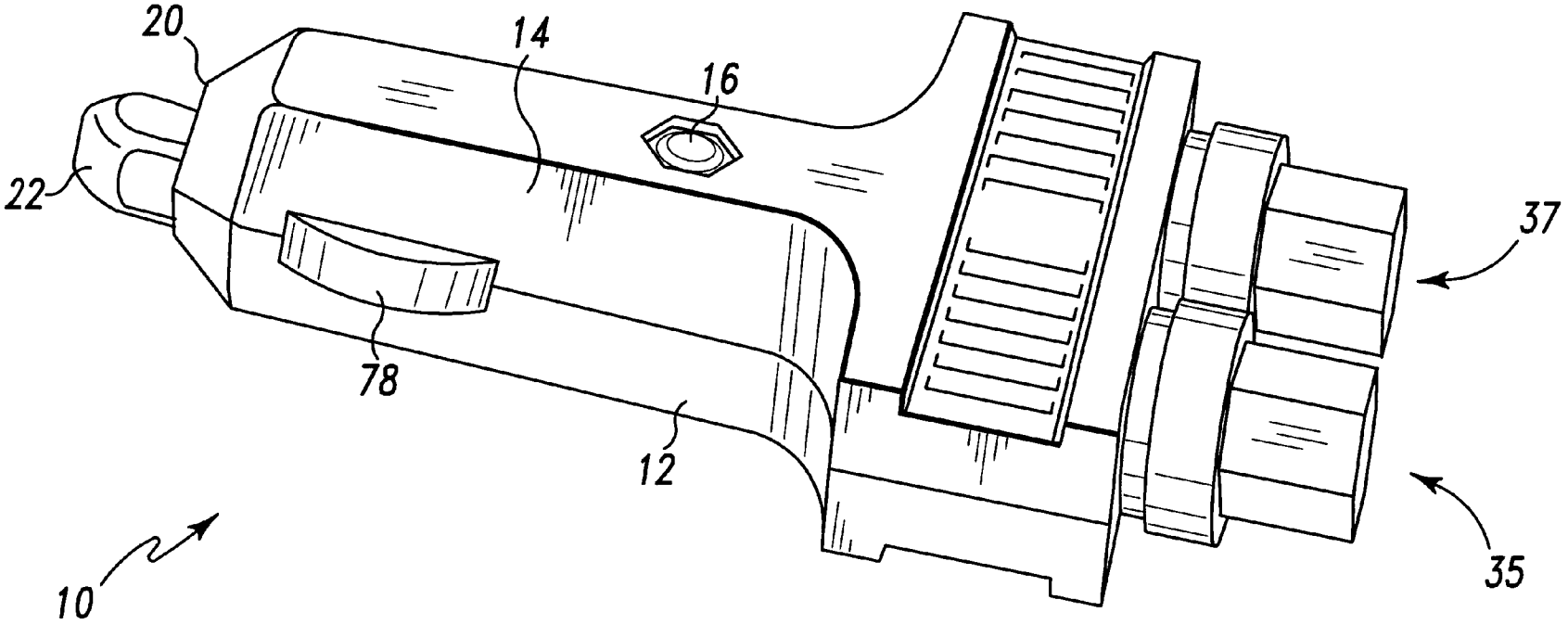
FIG. 1 is a side perspective view of a first embodiment of an adaptor of the present invention.

Corresponding reference characters indicate corresponding parts throughout the several views. Although the drawings represent multiple embodiments of the present invention, the drawings are not necessarily to scale and certain features may be exaggerated or omitted in some of the drawings in order to better illustrate and explain the present invention.

DESCRIPTION OF THE PREFERRED EMBODIMENTS

Figure 2:
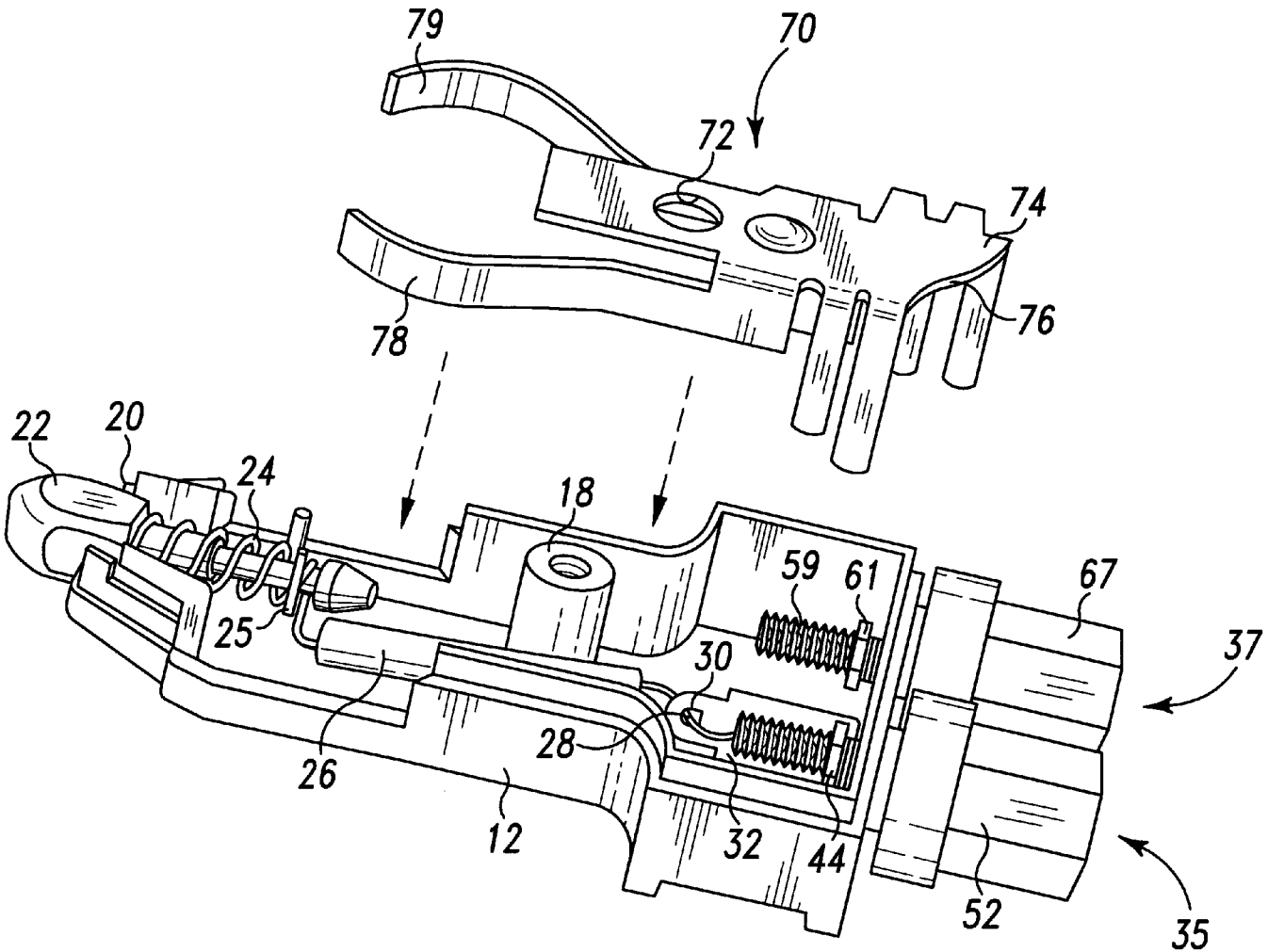
FIG. 2 is a partially exploded side perspective view of the adaptor of FIG. 1, wherein the top half of the adaptor housing is not shown.
Figure 3:
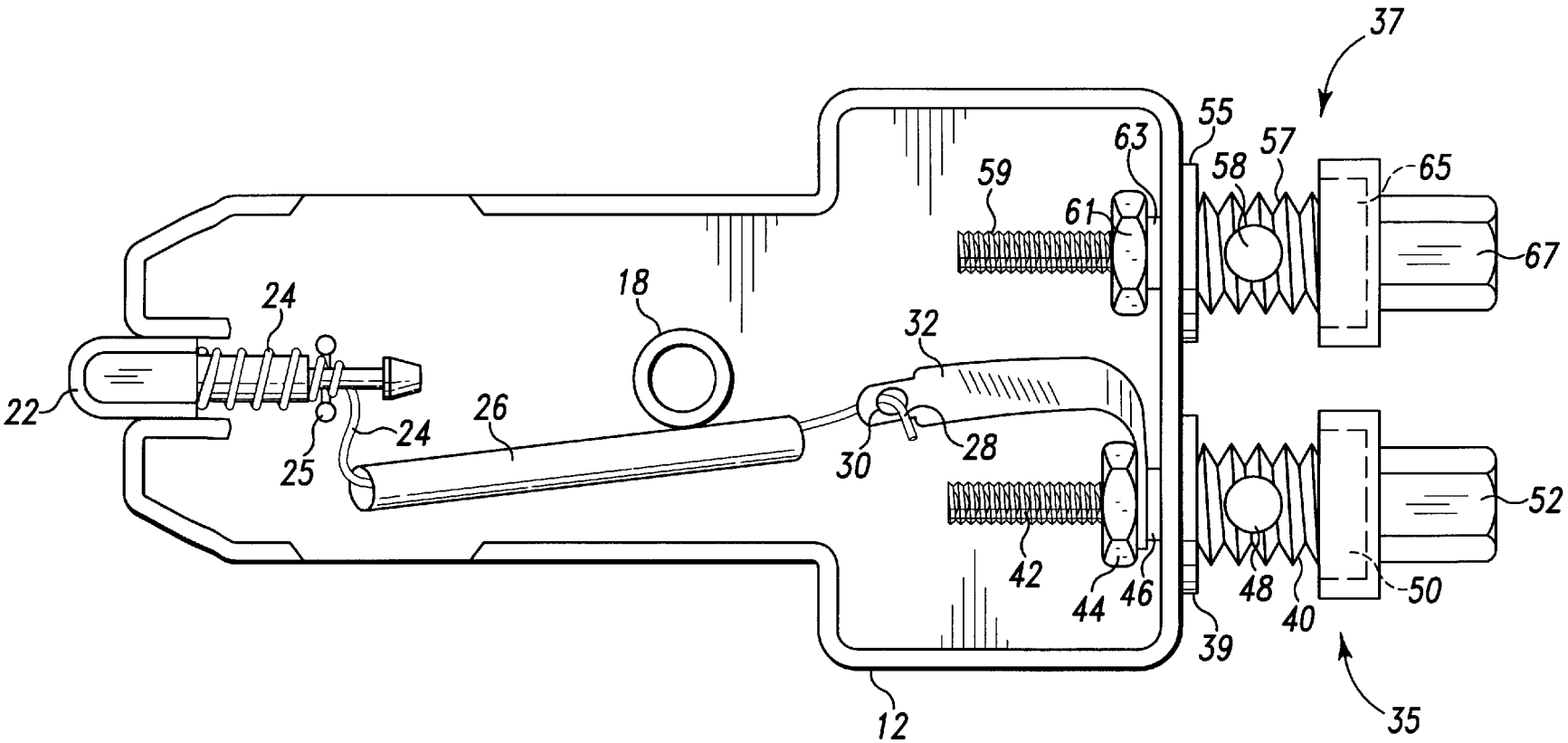
FIG. 3 is a diagrammatic top view of the adaptor of FIG. 2, wherein the leaf-spring conductor member in spaced relationship with the remainder of the adaptor in FIG. 2 has been removed for purposes of illustration, and wherein the external electrical terminals are shown in a position adapted to allow insertion of the electrical wires of an appliance requiring powering.

With reference to FIGS. 1–3, there is shown a first embodiment of an adaptor, generally designated 10, which is configured according to the present invention. Adaptor 10 includes a plastic housing assembled from a bottom housing section 12 and a top housing section 14. Housing sections 12 and 14 are connected together by bolt 16 which extends through an upstanding collar 18 integral with the interior facing portion of bottom housing section 12. Bolt 16 is secured with a nut (not shown) provided along the exterior of bottom housing section 12. Projecting from the rearward or insertion end 20 of the housing is a spring loaded contact 22. When insertion end 20 of adaptor 10 is operationally inserted into a cigarette lighter socket, contact 22 electrically connects with an electrical contact located at the base of that cigarette lighter socket.

The metal spring 24 which abuts housing flange 25 and biases contact 22 rearward serves as an electrical conductor. Metal spring 24 straightens out and extends through an insulating sleeve 26. The forward end segment 28 of spring 24 fits through opening 30 provided in an L-shaped metal bracket 32, and spring segment 28 contacts metal bracket 32 to provide an electrical connection therebetween.

The trailing end of adaptor 10 includes an externally accessible positive terminal, generally designated 35, and a negative terminal, generally designated 37. Positive terminal 35 comprises a metal shaft, extending through a metal washer 39 and a bore in the housing bottom section 12, that includes external shaft portion 40 and reduced diameter shaft portion 42. Both of shaft portions 40 and 42 are externally threaded. Nut 44 screws onto shaft portion 42 to sandwich an apertured flange of bracket 32 inserted onto shaft portion 42 against washer 46. Tightening of nut 44 also serves to secure positive terminal 35 to the adaptor housing.

A wire receiving bore 48 transversely extends through shaft portion 40. An internally threaded metal contact 50 (abstractly shown in dashed lines in FIG. 3) is fixedly secured within plastic cap 52 and is threadedly received on shaft portion 40. Rotation of cap 52 causes cap 52 and contact 50 to axially move along shaft portion 40.

Except the lack of a connection with an element similar to bracket 32, negative terminal 37 is constructed similar to positive terminal 35 and includes metal washer 55, threaded external shaft portion 57 with bore 58, reduced diameter threaded shaft portion 59, nut 61, washer 63, internally threaded metal contact 65 and plastic cap 67.

When the leaf spring electrical conductor element, generally designated 70, is operationally installed within adaptor 10 (i.e. by inserting element 70 into the housing in the direction indicated by dashed arrows in FIG. 2 such that collar 18 fits through opening 72), the portion of the element top section indicated at 74 directly contacts nut 61. It will be appreciated that the tapering or notching of the otherwise symmetrical conductor element 70 results in a set-back edge portion 76 which is spaced from nut 44 when operationally inserted. Conductor element 70 is in spaced apart relationship with all of the components of positive terminal 35 to avoid forming a direct electrical connection therewith. The rearward end of conductor element 70 is provided with two radially projecting leaf spring fingers 78 and 79. When adaptor 10 is operationally inserted into a cigarette lighter socket, leaf spring fingers 78 and 79 electrically connect with electrical contacts located along the side of the cigarette lighter socket.

The structure of adaptor 10 will be further understood in view of the following explanation of its operation. A person may employ adaptor 10 to hook up his or her CB (or other electrical appliance) in a vehicle or other location where a cigarette lighter is present. Before adaptor insertion, the externally accessible positive and negative terminals 35 and 37 are manipulated so as to be arranged as shown in FIG. 3. After one of the wires from the appliance is inserted through transverse bore 48 of shaft portion 40, cap 52 is rotated down sufficiently to cause the inserted wire to be pressed against shaft portion 40 by cap contact 50 to electrically circuit the inserted wire with the positive terminal 35. Similarly, the other wire from the appliance is inserted through transverse bore 58 of shaft portion 57 and cap 67 is rotated down to cause this other inserted wire to be electrically circuited with negative terminal 37.

Next, after removing the plug-in portion of the cigarette lighter from the lighter socket, a person inserts adaptor 10 into the cigarette lighter socket. As a result, an electrical circuit is formed such that electricity effectively passes from the lighter socket through contact 22, spring 24, bracket 32, and shaft portions 42, 40 into the appliance wire and the appliance, and then back from the other appliance wire through shaft portions 57, 59, nut 61, conductor element 70, and then through leaf spring fingers 78, 79 back to the lighter socket. More than one appliance may be circuited with adaptor 10 by inserting multiple wires through bores 48 and 58.

Figure 4:
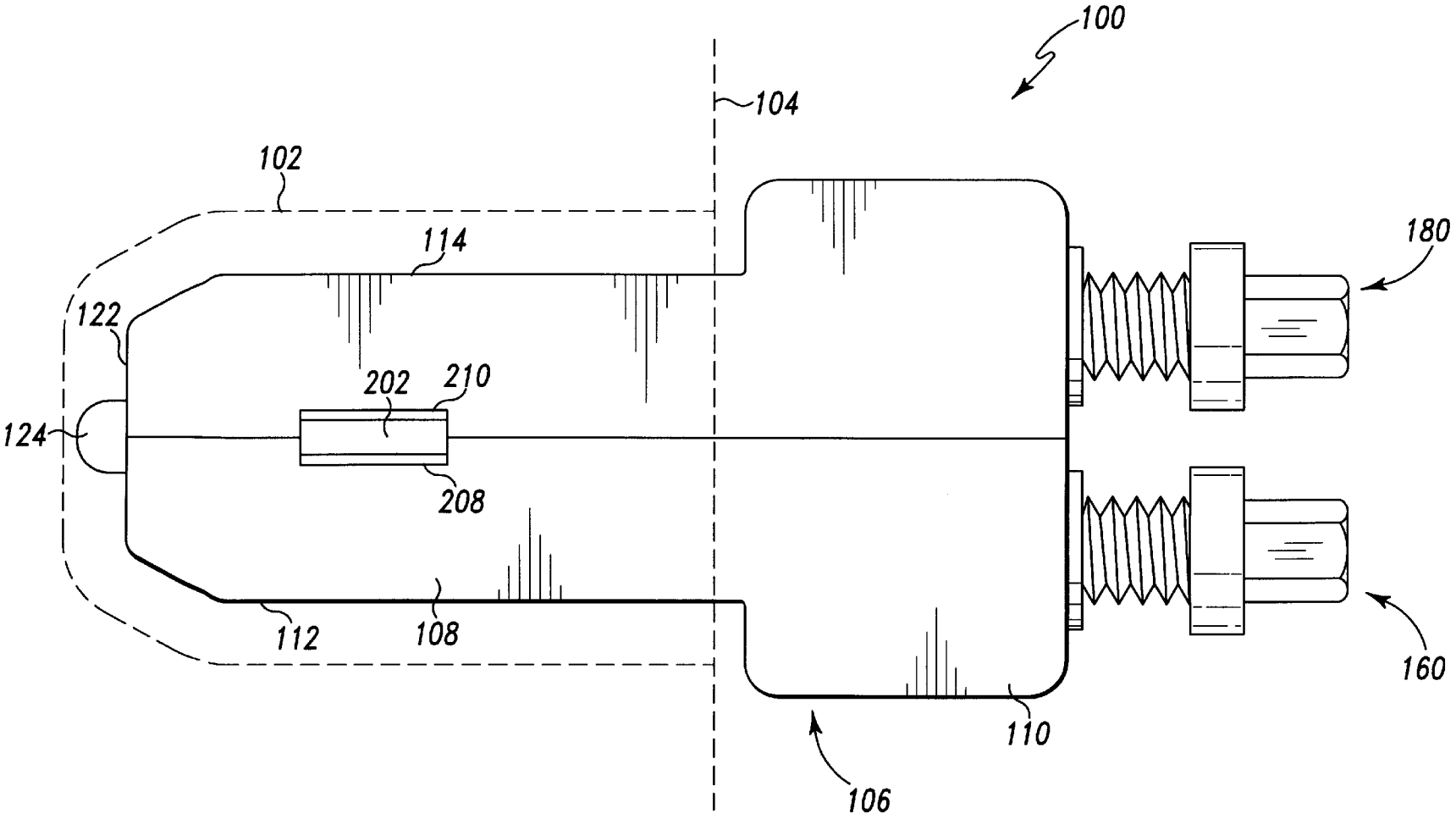
FIG. 4 is a side view of a second embodiment of an adaptor of the present invention shown operationally installed in a cigarette lighter socket shown abstractly in dashed lines.
Figure 5:
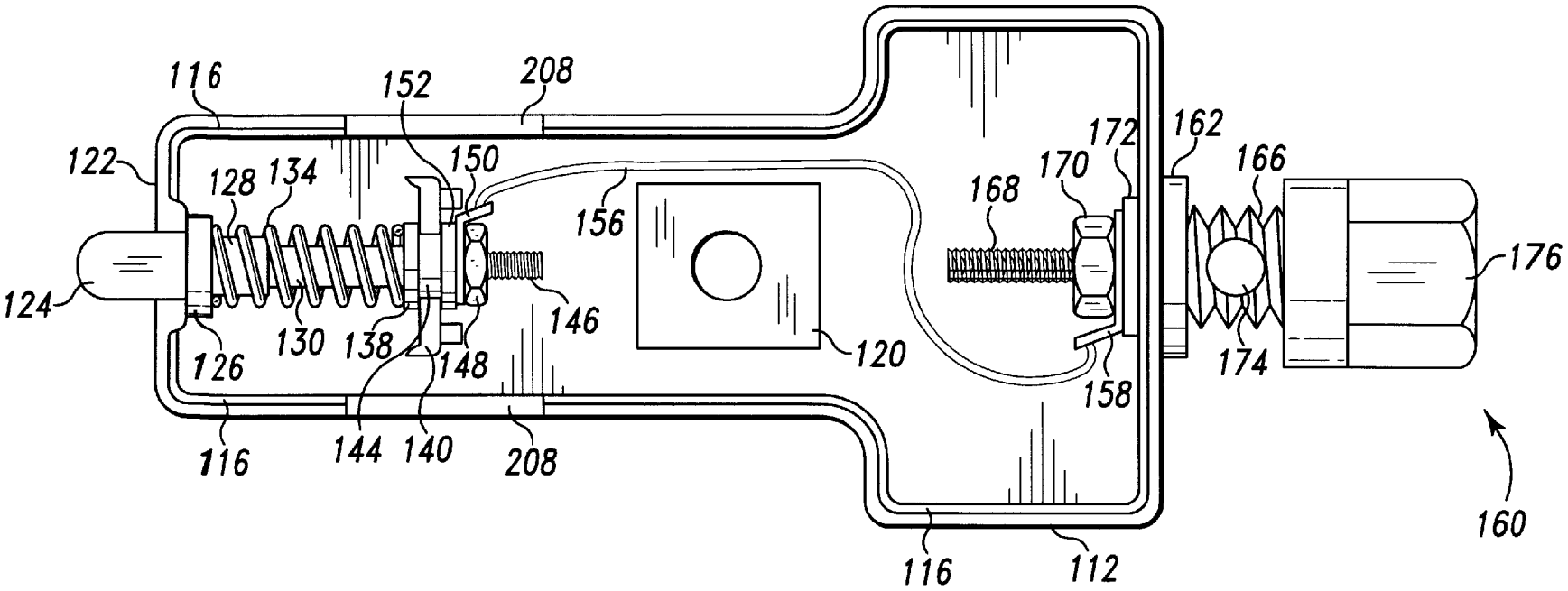
FIG. 5 is a top view of the bottom housing portion of the adaptor of FIG. 4 disassembled from the top portion.
Figure 6:
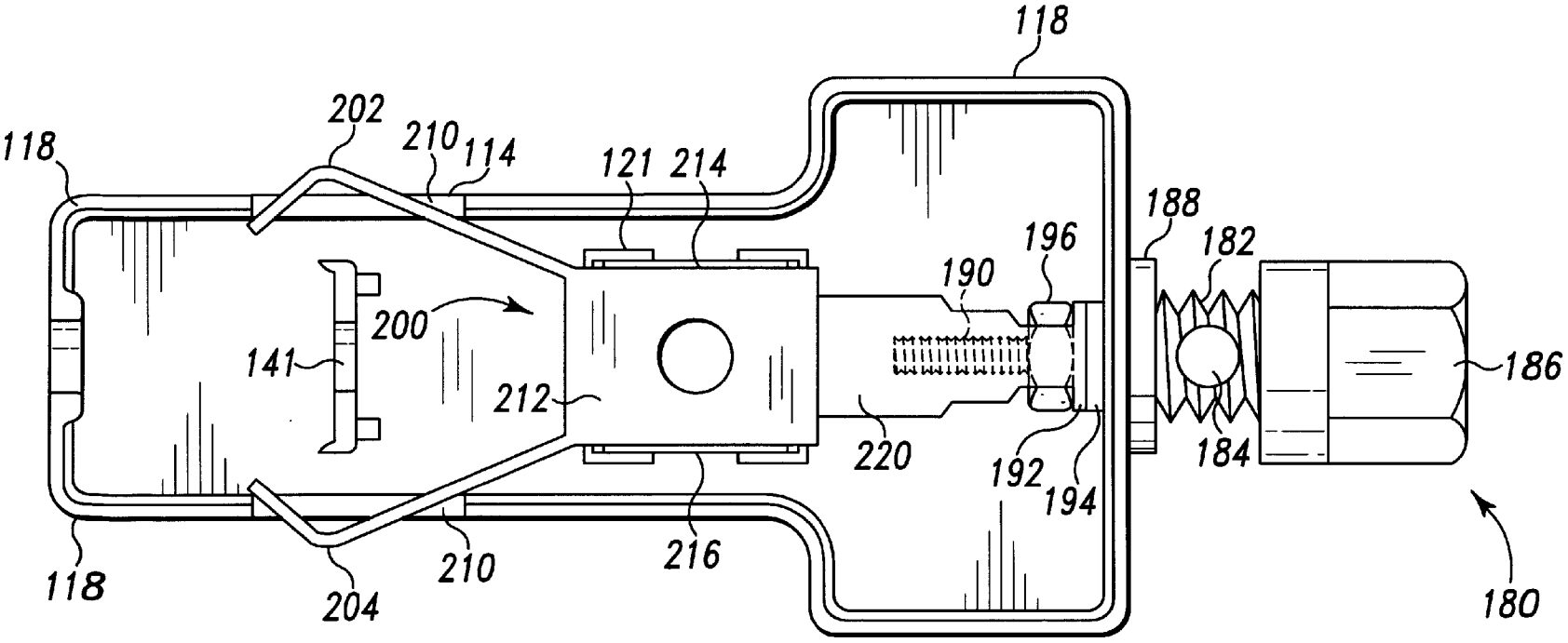
FIG. 6 is a bottom view of the top housing portion of the adaptor of FIG. 4 disassembled from the bottom housing portion.

With reference now to FIGS. 4–6, there is shown a second embodiment of an adaptor, generally designated 100, which is configured according to the present invention. In FIG. 4, adaptor 100 is shown operationally installed in a cigarette lighter socket, abstractly indicated in dashed lines at 102, which ports to the dashboard 104 which faces into the vehicle cab. The cigarette lighter plug which may be reinserted into socket 102 when adaptor 100 is removed when not being used, as well as the socket contacts, the vehicle power source or battery, and the electrical conductors extending therebetween, are not shown as such are of standard design and well known in the art.

Adaptor 100 includes a plastic housing 106 formed with a slightly rearwardly tapered cylindrical section 108 that blends at its forward end into an enlarged cylindrical portion 110. Tapered housing section 108 is complementarily sized and shaped with socket 102 to be insertable therein. Housing 106 is constructed from a bottom housing section 112 and a top housing section 114 which are mated during assembly. Upstanding rib 116, which is spaced from the periphery of housing section 112, and upstanding rib 118, which generally extends along the periphery of housing section 114, are cooperatively configured to ensure housing sections 112 and 114 are properly mated during assembly. Housing sections 112 and 114 are connected together by a bolt (not shown) which extends through apertured, upstanding square collars 120, 121 which are respectively integrally formed with the interior facing portions of the bottom and top housing sections. The bolt is secured with a nut (not shown) provided along the exterior of bottom housing section 112. The head of the bolt and the nut fit within not shown recesses provided in the exterior surfaces of housing sections 112 and 114.

Projecting from insertion end 122 of the housing is a spring loaded contact 124. When adaptor 100 is operationally inserted into cigarette lighter socket 102 as shown in FIG. 4, contact 124 abuts the not shown electrical contact located at the inward end or base of cigarette lighter socket 102 and makes an electrical connection with such socket contact. During adaptor insertion into socket 102, plug contact 124 abuts the socket contact and is moved, against the force of its spring biasing, into the adaptor housing.

As shown in FIG. 5, metal contact 124 includes annular shoulder 126. The rearward face of shoulder 126 abuts the housing surfaces defining the aperture through which contact 124 ports to retain contact 124 within the housing. A sleeve portion 128 of contact 124 receives the tip of a metal rod 130 and is free to slide therealong. The opposite ends of a metal, coiled spring 134 abut the faces of contact shoulder 126 and annular shoulder 138 of rod 130, and spring 134 serves to bias contact 124 out of the adaptor housing. Rod shoulder 138 abuts ribbed flanges 140, 141 integrally formed with housing sections 112 and 114 which serve to axially retain rod 130. Each of ribbed flanges 140, 141 includes an arcuate recess in which nests an enlarged diameter portion 144 of rod 130. Rod 130 includes a reduced diameter, threaded portion 146 onto which screws metal nut 148. Nut 148 sandwiches an apertured flange of a generally L-shaped metal bracket 150 inserted onto rod portion 146 against metal washer 152. A first end of conductor wire 156 is soldered or otherwise electrically connected to bracket 150, and the second end of wire 156 is soldered to a second generally L-shaped bracket with an apertured flange 158. Except for its exposed ends, wire 156 is encased within an electrically insulative covering to prevent a short upon any contact with the electrical components housed within adaptor housing 106.

Bracket 158 is electrically circuited to an an externally accessible positive terminal, generally designated 160. Similar to positive terminal 35, terminal 160 comprises a metal shaft, extending through a metal washer 162 and a bore in the housing bottom section 112, that includes external shaft portion 166 and reduced diameter shaft portion 168. Both of shaft portions 166 and 168 are externally threaded. Metal nut 170 screws onto shaft portion 168 to sandwich the apertured flange of metal bracket 158 inserted onto shaft portion 168 against metal washer 172. Tightening of nut 170 also serves to secure positive terminal 160 to the adaptor housing.

Wire receiving bore 174 transversely extends through shaft portion 166. A hexagonal plastic cap 176 with an internally threaded metal contact (not shown) is constructed and is operated similarly to cap 52 and contact 50 of the embodiment of FIGS. 1–3.

With reference now to FIG. 6, the negative terminal, generally designated 180, is constructed similarly to positive terminal 160 and includes threaded external shaft portion 182 with bore 184, cap assembly 186, washer 188, reduced diameter threaded shaft portion 190 (shown in dashed lines), and a conductive apertured bracket 192 sandwiched against internal washer 194 by nut 196.

A metal, leaf spring electrical conductor element, generally designated 200, is operationally installed within adaptor 100 so as not to be in contact with any of the electrical components circuiting positive terminal 160 to contact 124. Conductor element 200 includes two radially projecting leaf spring fingers 202 and 204 which as shown in FIG. 4 extend through aligned notches 208, 210 provided in housing sections 112 and 114 to project beyond the housing periphery. Conductor element 200 includes a rectangular body 212 integrally formed with fingers 202 and 204 and from which orthogonally project flanges 214, 216. Flanges 214, 216 insert within slots formed in collar 121 to retain conductor element 200 in its proper orientation within housing 106. A tab 220 extending from body 212 is shown integrally formed with bracket 192 that circuits to the negative terminal 180, but in alternate embodiments the bracket may be formed separate from the conductor element and then electrically connected thereto, such as by soldering, at a later stage of adaptor assembly. Leaf spring fingers 202 and 204 serve to electrically connect with electrical contacts disposed along the sides of cigarette lighter socket 102 when adaptor 100 is operationally inserted as shown in FIG. 4.

The above described components of adaptor 100 result in an electrical circuit being formed between contact 124 and positive terminal 160, wherein electricity may pass from contact 124 to rod 130, to bracket 150, which may be circuited directly to rod 130 or indirectly by way of washer 152 and nut 148, to wire 156, to bracket 158, which may be circuited with shaft portion 168 directly or indirectly by way of washer 172 and nut 170, and to shaft portions 166 and 168 to reach positive terminal 160. An electrical circuit is also formed between negative terminal 180 and fingers 202 and 204 wherein electricity may pass from shaft portion 182 to shaft portion 190 and then pass to bracket 192, which may be circuited directly to shaft portion 190 or indirectly by way of washer 194 and nut 196, to tab 220, to conductor body 212 and to fingers 202 and 204.

While this invention has been shown and described as having preferred designs, the present invention may be modified within the spirit and scope of this disclosure. For example, the shown and described configurations of the internal electrical circuitry may be replaced with various other configurations of circuitry which achieve the electrical connections between the externally accessible positive and negative terminals and the adaptor contacts which electrically circuit with the contacts of the cigarette lighter socket. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical adaptor comprising:

a plug member sized and configured to insert within a cigarette lighter socket circuited to a power source;

first and second electrical contacts positioned externally on said plug member and adapted to electrically connect with socket contacts when said plug member is inserted into the socket;

a first electrical terminal positioned externally on said plug member and adapted for connection to a first lead of an electrical appliance;

a second electrical terminal positioned externally on said plug member and adapted for connection to a second lead of the electrical appliance;

wherein said first electrical terminal and said second electrical terminal each comprises a first portion and a second portion, said second portion of said first electrical terminal is structured and arranged to be movable along a length of said first portion of said first electrical terminal, and said second portion of said second electrical terminal is structured and arranged to be movable along a length of said first portion of said second electrical terminal;

a first circuit electrically connecting said first electrical terminal with said first electrical contact; and a second circuit electrically connecting said second electrical terminal with said second electrical contact.

2. The electrical adaptor of claim 1 wherein said plug member comprises first and second ends, wherein said first electrical contact projects from said plug member first end, and wherein said first and second electrical terminals project from said plug member second end.

3. The electrical adaptor of claim 1 wherein said second electrical contact comprises a pair of resilient fingers projecting from opposite side surfaces of said plug member.

4. The electrical adaptor of claim 1 wherein said first portion of each of said first and second electrical terminals comprises a threaded shaft portion, and wherein said second portion of each of said first and second electrical terminals comprises an internally threaded cap engaged with said threaded shaft portion and rotatable to axially advance along the length of said shaft portion.

5. The electrical adaptor of claim 4 wherein said threaded shaft portion of each of said first and second electrical terminals comprises a lead receiving bore extending transversely therethrough.

6. The electrical adaptor of claim 4 wherein said threaded shaft portions of said first and second electrical terminals comprise metal, and wherein said internally threaded caps of said first and second electrical terminals each comprises an internally threaded metal insert and a plastic cover of said insert.

7. The electrical adaptor of claim 1 wherein said plug member comprises a housing with a hollow interior, wherein said first circuit and said second circuit are disposed within said hollow interior, wherein said housing comprises first and second shell portions, and wherein said first electrical terminal is attached to said first shell portion and said second electrical terminal is attached to said second shell portion.

8. An adaptor for circuiting an appliance to a power source circuited with a cigarette lighter socket, comprising:

a body having an insertion end and a distal end opposite said insertion end, said body movable to an operational position at which said body insertion end is removably inserted within the cigarette lighter socket;

means on said body for forming electrical connections with contacts of the cigarette lighter socket circuited to the power source when said body in disposed in said operational position;

means on said body for attachment to wires of an electrical appliance to be powered by the power source, said wire attachment means comprising first and second threaded shafts for electrical attachment with first and second wires, respectively, of the electrical appliance; and means for electrically interconnecting said wire attachment means and said means for forming electrical connections.

9. The adaptor of claim 8 wherein said wire attachment means project from said distal end of said body in a direction opposite to the direction in which said body is insertable into the cigarette lighter socket.

10. The adaptor of claim 8 wherein said first and second threaded shafts each comprises a wire receiving bore extending transversely therethrough.

11. The adaptor of claim 10 wherein said wire attachment means further comprises first and second cap assemblies that respectively engage said first and second threaded shafts and that are rotatable to be moved axially along said shafts.

12. The adaptor of claim 11 wherein each of said first and second cap assemblies comprises an electrically conductive insert that threadedly engages one of the threaded shafts, and an electrically non-conductive cover of said insert.

13. A method of circuiting an electrical appliance to a power source of a vehicle including a cigarette lighter socket connected to the power source, comprising the steps of:

providing an adaptor comprising a housing, first and second contacts respectively projecting from an insertion end and a side of said housing, first and second electrical terminals protruding from said housing to be externally accessible, a first electrical circuit within said housing and connecting said first contact and said first electrical terminal, and a second electrical circuit within said housing and connecting said second contact and said second electrical terminal;

connecting a first lead of the electrical appliance to said first electrical terminal;

connecting a second lead of the electrical appliance to said second electrical terminal; and connecting first and second leads of a second electrical appliance to said first and second electrical terminals, respectively; and inserting said adaptor into the socket such that said first and second contacts are electrically circuited with contacts of the socket to thereby circuit the first and second appliance leads with the vehicle power source.

14. The method of claim 13 wherein the steps of connecting said first and second leads to said first and second electrical terminals occurs while said adaptor is inserted within the socket.

* * * * *